US005586733A

United States Patent [19]

Miura et al.

[11] Patent Number: 5,586,733

[45] Date of Patent: Dec. 24, 1996

[54] TAKE-UP REEL FOR METALLIC FILAMENTS

[75] Inventors: Yoshihiro Miura; Masami Goto, both of Tochigi-ken, Japan

[73] Assignee: Bridgestone Metalpha Corporation, Tokyo, Japan

[21] Appl. No.: 504,007

[22] Filed: Jul. 19, 1995

[30] Foreign Application Priority Data

Jul. 21, 1994 [JP] Japan ..... 6-191878

[51] Int. Cl.[6] ..... B65H 75/28; B65H 51/015

[52] U.S. Cl. ..... 242/125.2; 242/172

[58] Field of Search ..... 242/125.1, 125.2, 242/125.3, 172, 25 R, 129, 580

[56] References Cited

U.S. PATENT DOCUMENTS

| | | | |
|---|---|---|---|
| 1,408,261 | 2/1922 | Brookhart | 242/125.2 X |
| 1,441,462 | 1/1923 | Tuttle | 242/125.1 |
| 2,374,111 | 4/1945 | Le Tourneau | 242/125.1 |
| 3,284,023 | 11/1966 | Sowell | 242/125.1 |
| 3,994,058 | 11/1976 | Sasaki et al. | 242/125.1 X |
| 4,019,543 | 4/1977 | Sasaki et al. | 242/125.2 X |
| 4,715,557 | 12/1987 | Rushing et al. | 242/125.1 X |
| 4,718,633 | 1/1988 | Weixel | 242/129 |
| 5,062,580 | 11/1991 | Meagher | 242/125.2 |
| 5,320,301 | 6/1994 | Cross | 242/125.2 X |
| 5,460,333 | 10/1995 | Vanhuyse | 242/125.1 X |
| 5,485,968 | 1/1996 | Fujioka | 242/125.2 |

FOREIGN PATENT DOCUMENTS

| | | | |
|---|---|---|---|
| 875573 | 5/1953 | Germany | 242/125.2 |

*Primary Examiner*—Michael R. Mansen
*Attorney, Agent, or Firm*—Jordan and Hamburg

[57] ABSTRACT

A metallic-filament take-up reel by which a metallic filament wound on a winding drum is retained inside at least one of flanges thereof. The reel comprises a winding drum; two flanges in at least one of which there are formed an access hole and a concavity indented from inside toward outside the flange and having a slit formed vis-à-vis to the access hole; and a metallic-filament retainer so rigid and resilient as to catch a metallic filament, provided as secured to the flange and composed of a hook portion which is to be moved through the access hole to catch a metallic filament, a base portion and an intermediate portion rising from the base portion and extending contiguously between the hook and base portions; the retainer being fixed at the base portion thereof to the flange after inserted through the slit from the outer circumference of the flange; the intermediate portion being able to be bent as pushed, when the retainer is used, until the hook portion looking at the access hole moves through the access hole to the winding-drum side from outside toward inside the flange to resiliently retain a trailing end portion of a metallic filament wound on the winding drum.

5 Claims, 7 Drawing Sheets

TAKE-UP REEL FOR METALLIC FILAMENTS

BACKGROUND OF THE INVENTION

The present invention relates to a reel for receiving thereon a metallic filament such as steel cord, steel wire or the like, and more specifically, to a metallic-filament take-up reel adapted to retain, inside a flange thereof, a trailing end portion of a metallic filament wound on a drum thereof.

A typical one of the prior-art metallic-filament take-up reels is shown in FIG. 1. The take-up reel is generally indicated with $R_0$. To retain a trailing end portion $W_a$ of a metallic filament wound on a winding drum (not shown), the take-up reel $R_0$ has a hole 32 formed in a flange 31 thereof near a circumferential edge 33 of the flange 31 and through which a metallic filament is led out at the trailing end thereof from inside the flange 31. The lead-out hole 32 is somewhat larger in diameter than the metallic filament. A clip-like retainer A is provided fixed to the circumferential edge 33 on the outer side of the flange 31 and in the vicinity of the lead-out hole 32. In this metallic-filament take-up reel $R_0$, the end portion $W_a$ of the metallic filament wound on the winding drum is led out through the hole 32 and retained by the clip-like retainer A. However, it is time consuming to retain the metallic filament $W_a$ using the retainer A. The existence of the end portion $W_a$ of the metallic filament retained on the outer side of the flange 31 is also an impediment to handling in transport or storage of the take-up reel $R_0$. To unwind the metallic filament, the end portion $W_a$ thereof has to be released from the retainer A and pulled back to the winding drum through the lead-out hole 32, which is very troublesome and requires much labor.

The extremity of the cut end portion $W_a$ of many stranded metallic filaments such as steel cord or the like is often not solidly stranded. To insert such metallic filament into the lead-out hole 32, the extremity of the end portion $W_a$ thereof has to be corrected for easy insertion. Therefore, guiding of the end portion $W_a$ into the lead-out hole 32 cannot be automated but has to be manually done, which adds much to the winding work.

To overcome the above-mentioned drawbacks of the prior art, it has been proposed to use a novel take-up reel in which the trailing end portion of a metallic filament wound thereon can be retained inside a flange thereof. This metallic-filament take-up reel will be discussed below with reference to FIGS. 2 and 3. This reel is generally indicated with $R_1$. The reel $R_1$ is provided with two flanges 21. At least one of the flanges 21 has an access hole 22 formed therein, and also has fixed thereto a resilient retainer B composed of a hook portion 23 which retains a metallic filament, a base portion 24 and an intermediate portion 25 extending contiguously between the hook and base portions 23 and 24. The retainer B is secured at the base portion 24 thereof to the flange 21. To retain the end portion $W_a$ of a metallic filament, the hook portion 23 is bent as pushed and protruded through the access hole 21 to inside the flange 21. As shown, the metallic filament $W_a$ is caught and retained between the outer surface of the hook portion 23 and the inner surface of the flange 21. This metallic-filament take-up reel $R_1$ functions well but is disadvantageous in some respects.

One of the disadvantages lies in the adhesion of the base portion 24 of the retainer B to the flange 21. To retain a metallic filament on the flange, the hook portion 23 of the retainer B is to be pushed into the access hole 22 in the flange 21 until it protrudes from the inner side of the flange 21 to a sufficient extent to receive the metallic filament between the inner surface of the flange 21 and the outer surface of the hook portion 23. The metallic filament is thus retained on the flange inner surface under the resilience of the retainer B. For a secure retention of the metallic filament, the retainer B should have a large resilience. In this case, a great force has to be applied to the highly resilient retainer B to move the hook portion 23 to inside the flange 21. In turn, however, the high resilience will create a large counter-force acting on the retainer B, namely, on the base portion 24 which may thus possibly be separated from the flange 21.

Secondly, spot welding, if employed to fix the base portion 24 to the outer surface of the flange 21, is likely to cause a deflection of the retainer B, resulting in a larger or smaller retention by the retainer B or an uneven contact of the hook portion 23 with a metallic filament. Such deflection will present adequate retention of the metallic filament.

Thirdly, the base portion 24 is fixed to the flange 21 and elaborately positioned on the flange 21 for the hook portion 23 of the retainer B to smoothly pass through the access hole 22. For the take-up reel $R_1$, however, the positioning needs much labor and time, which makes it difficult to manufacture the take-up reels $R_1$ at reduced costs.

Moreover, to facilitate the fixation of the retainer B to the flange 21, the access hole 22 is located at a position where it is easily seen from outside the flange 21, namely, at a position nearer to the winding drum. Therefore, only a limited length of the metallic filament can be wound on the winding drum of the reel $R_1$.

SUMMARY OF THE PRESENT INVENTION

The present invention has an object to overcome the above-mentioned drawbacks of the prior art by providing a novel and improved metallic-filament take-up reel having formed on at least one flange thereof a concavity intended for positioning a retainer with respect to an access hole formed in the flange and in which the retainer is fitted and secured at a base portion thereof to the inner surface of the flange so that the retainer abuts a portion of the outer surface of the flange at other than the base portion thereof when the retainer is used, whereby the deflection of the retainer can be minimized even when spot welding is used to secure the retainer to the flange.

The above object is attained by providing a metallic-filament take-up reel comprising, according to the present invention, a winding drum; two flanges in at least one of which there are formed an access hole and a concavity indented from inside toward outside the flange and having a slit formed vis-à-vis to the access hole; and a metallic-filament retainer so rigid and resilient as to retain a metallic filament, provided as secured on the flange and composed of a hook portion which is to be moved through the access hole to catch a metallic filament, a base portion and an intermediate portion rising from the base portion and extending contiguously between the hook and base portions; the retainer being fixed at the base portion thereof to the flange after inserted through the slit from the outer circumference of the flange; the intermediate portion being able to be bent as pushed, when the retainer is used, until the hook portion looking at the access hole moves through the access hole to the winding-drum side from outside toward inside the flange to resiliently retain a trailing end portion of a metallic filament wound on the winding drum.

Preferably, the base portion of the retainer should be fitted in the concavity and secured there to the inner surface of the flange so as not to protrude from the inner surface of the flange, the intermediate and hook portions should be located outside the flange, and the access hole be formed in the flange should be in the vicinity of the rounded outer circumferential edge of the flange. Additionally, the winding drum of the metallic-filament take-up reel should preferably have formed axially therein a plurality of holes having a same diameter and circumferentially therein a plurality of holes having different diameters.

The flanges of the reel according to the present invention may be manufactured by forming simultaneously, by stamping, the access hole and the concavity which positions the base portion of the retainer, each having dimensions corresponding to those of the metallic-filament retainer.

According to the present invention, a metallic filament is resiliently retained by the hook portion of the retainer of which the base portion is fixed to the flange and which abuts at other than the base portion thereof a portion of the flange other than the indented flange portion. Therefore, the base portion is rigidly secured to the flange to prevent separation from the flange.

When the hook portion of the retainer is pushed to inside the flange through the access hole, the resilience of the retainer will act to separate the base portion from the flange. To prevent the base portion from being separated from the flange, the concavity is so formed that a portion of the flange other than the indented portion also bears the resilience. More particularly, since the resilience of the retainer apt to separate the base portion from the flange is not only counterbalanced with the adhesion of the base portion to the flange but also born by above-mentioned portion of the flange, the base portion remains rigidly secured to the flange. Further, since the retainer is correctly positioned by the concavity and slit and thus limited from being deflected due to spot welding the retainer to the flange, the metallic filament can be securely retained under a constant resilience.

As mentioned above, the winding drum has a plurality of holes having a same diameter axially formed therein and also a plurality of holes having different diameters circumferentially formed therein, which however is not limited only to the present invention. When metallic filaments having different diameters are to be taken up on one reel, it is possible to select from such holes in the winding drum a suitable one for each filament diameter and insert the leading end of the metallic filament into the hole, which assures a positive winding of the metallic filament without any failure in fixation of the leading end to the winding drum. Also, metallic filaments having different diameters can be taken up on one reel, which leads to an economic use of the reels.

In mass production of the prior-art metallic-filament take-up reels, the positioning of the retainer with respect to the access hole takes much labor and time, which results in a poor productivity. According to the present invention, however, the access hole is formed in the flange together with the concavity serving to position the base portion of the retainer. Thus the positioning problem with the prior art is solved in the present invention. Namely, the access hole and the concavity for positioning the base portion of the retainer are formed simultaneously by pressing during working of the flange. So the reel can be efficiently manufactured at reduced costs and with little labor.

These and other objects and advantages of the present invention will be better understood from the ensuing description made, by way of example, of the preferred embodiments of the present invention with reference to the drawings.

DETAILED DESCRIPTION OF THE PREFERRED EMBODIMENTS

Figure 1:
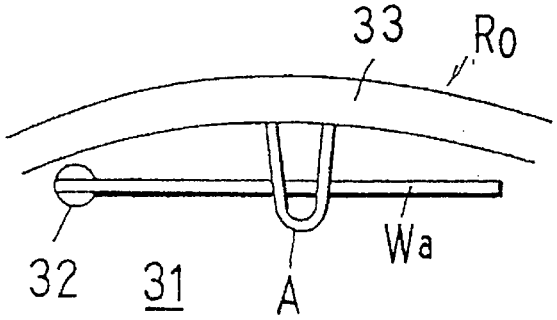
FIG.1 (PRIOR ART)
FIG. 1 is a front view of the filament retainer provided on the flange of a prior-art take-up reel from outside thereof.
Figure 2:
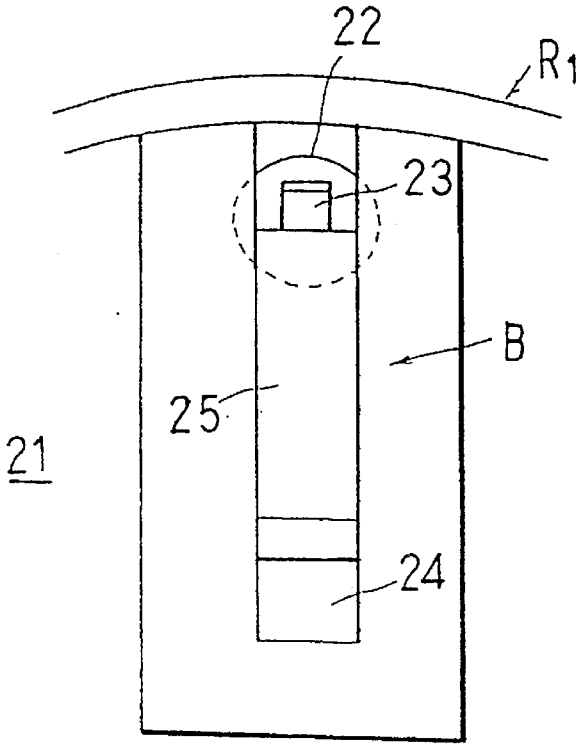
FIG.2 (PRIOR ART)
FIG. 2 is a front view of the essential part of the metallic-filament retainer provided on the flange of another prior-art take-up reel.
Figure 3:
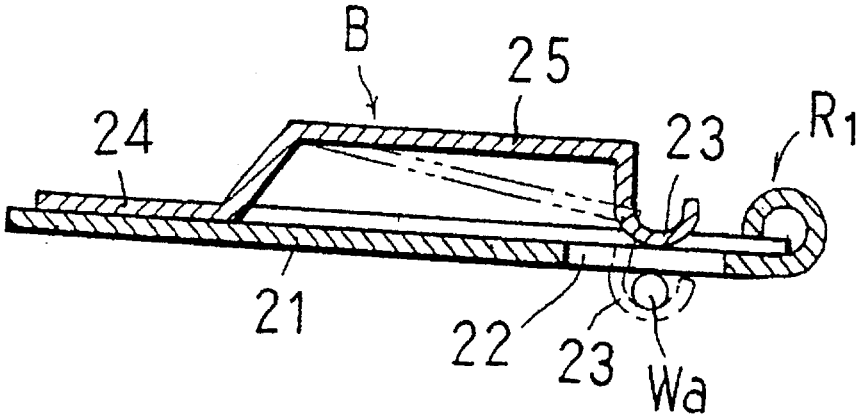
FIG.3 (PRIOR ART)
FIG. 3 is an axial sectional view of the retainer provided on the flange of the take-up reel in FIG. 2.
Figure 4:
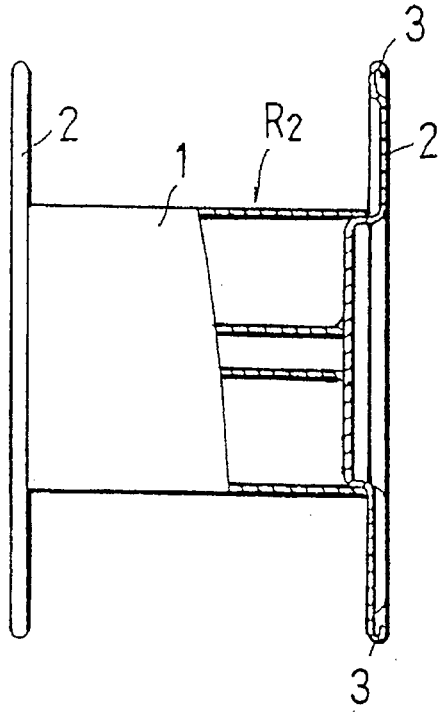
FIG. 4 is a partially sectional front view of the metallic-filament take-up reel according to the present invention.

FIG. 4 is a partially sectional front view of the metallic-filament take-up reel $R_2$ according to the present invention. As illustrated, the reel comprises a winding drum 1 on which a metallic filament is to be wound and flanges 2 provided vertically fitted to ends of the winding drum 1. Each flange 2 has a circumferential edge 3 thereof rounded outwardly as shown.

Figure 5:
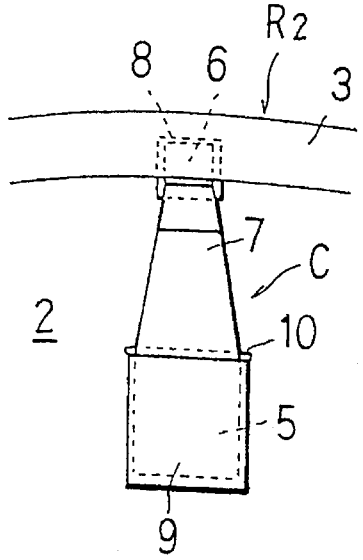
FIG. 5 is a plan view, partially enlarged in scale, of the retainer provided on the flange of the take-up reel in FIG. 4.
Figure 6:
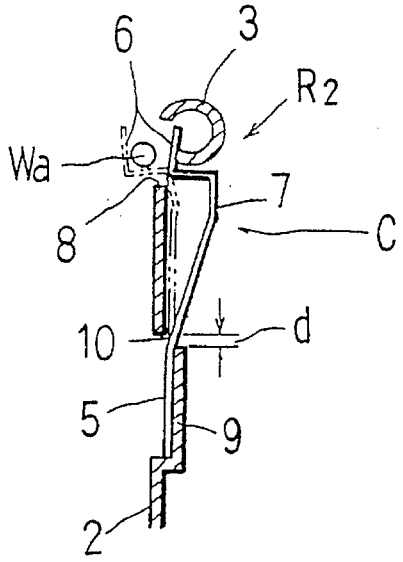
FIG. 6 is an axial sectional view of the retainer on the flange in FIG. 5.

FIG. 5 is a plan view, partially enlarged in scale, of the metallic-filament retainer C secured to the flange 2. FIG. 6 is an axial sectional view of the retainer C on the flange 2. As shown in FIG. 6, the retainer C retains a trailing end portion $W_a$ of a metallic filament wound on the winding drum 1. The retainer C is composed of a base portion 5 formed at one end thereof, a hook portion 6 formed at the other end and an intermediate portion 7 contiguously extending between the base and hook portions 5 and 6. The hook portion 6 is "L-shaped" to catch the end portion $W_a$ of the metallic filament wound on the winding drum 1. The intermediate portion 7 rises from the base portion 5 and imparts to the hook portion 6 a resilience under which the hook portion 6 is forced toward the flange 2 to retain the end portion $W_a$ of the metallic filament between the hook portion 6 and the circumferential edge 3 of the flange 2. In this embodiment, the retainer C is made of a plate-like resilient material and is bent to form the base, hook and intermediate portions 15, 16 and 17.

In the illustrated embodiment, the resilient material is 0.5 mm thick, and the base portion 5 is 10 mm wide. The intermediate portion 7 rises from the base portion 5 to a maximum height of about 4 mm. The hook portion 6 is 5 mm in width and has the end corners thereof rounded to facilitate passing the hook portion 6 through an access hole 8 formed in the flange 2 without scratching the metallic filament. The hook portion 6 should desirably be shaped to securely wrap and catch the metallic filament.

As mentioned above, the access hole 8 is formed in the flange 2 in the vicinity of the circumferential edge 3. Further, the flange 2 has formed therein a concavity 9 located at a position nearer (opposite to the access hole 8) to the center thereof and indented in a direction from inside (on the side of the winding drum 1) to outside the flange 2. The access hole 8 and concavity 9 are formed in line with each other and radially in relation to the flange 2. The concavity 9 has a slit 10 formed vis-à-vis to the access hole 8. The concavity 9 in the flange 2 is about 2 mm deep and 10 mm wide so that the base portion 5 of the retainer C does not protrude from the inner surface of the flange 2.

Generally, the access hole 8, concavity 9 and slit 10 are simultaneously formed by stamping in the flange 2.

According to the present invention, the base portion 5 of the retainer C is inserted from the slit 10 into the concavity 9 and secured there to the flange 2. Thus, the base portion 5 is received in the concavity 9 and should desirably be secured by spot welding to the surface of the flange 2 in the concavity 9. However, the base portion 5 of the retainer C may be secured to the flange 2 in the concavity 9 in any other appropriate manner. Namely, the base portion 5 may be fixed simply by fitting in the concavity 9 or caulking after fitting. It may be further fixed to the flange 2 by spot welding.

Since the access hole 8 is located in the vicinity of the circumferential edge 3 of the flange 2, an increased length of a metallic filament is taken up on the reel and deformation of the flange 2 is prevented.

According to this embodiment, the access hole 8 is generally square in shape, 6.5 mm wide circumferentially of the flange 2 and 7 mm wide in the direction of the circumferential edge 3 of the flange 2. Of course, the shape of the access hole 8 may be any one through which the hook portion 6 of the retainer C could be passed.

The hook portion 6 of the retainer C is located vis-à-vis to the access hole 8. To retain the trailing end portion $W_a$ of a metallic filament wound on the winding drum, the intermediate portion 7 is pushed by finger from outside the flange 2 to pass the hook portion 6 through the access hole 8 until it protrudes to inside the flange 2. Then, the end portion $W_a$ of the metallic filament is put into between the hook portion 6 and the inner surface of the flange 2. When the finger is taken away from the intermediate portion 7 to release the latter, the end portion $W_a$ of the metallic filament is caught and retained by the retainer C.

It is economically desirable to form the concavity 9 in the flange 2 by stamping as mentioned above. However, the purpose of the concavity 9 can be attained by any member other than the concavity. For example, a member having a concavity similar to the concavity 9 is separately made of a same material as, or any material different from, that of the flange 2 and secured by any arbitrary means to the outer surface of the flange 2 in a position corresponding to the concavity 9.

In case the concavity 9 is formed by pressing, the slit 10 is formed to be flush with the upper end of the concavity 9 or to have a gap d from the upper end as shown in FIG. 6. In case the above-mentioned other member is used, however, the member is located on the outer surface of the flange 2 without such a gap d.

Figure 7:
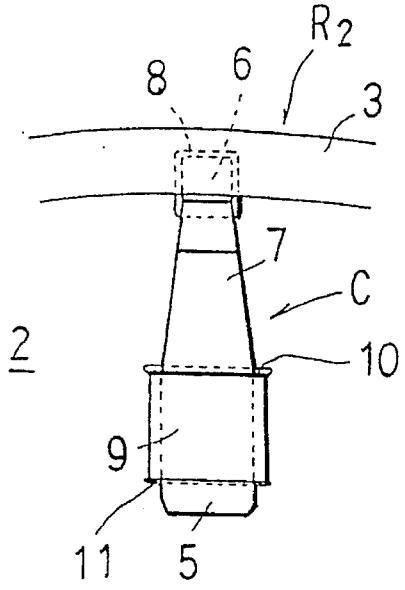
FIG. 7 is a plan view showing a variant of the fixation of the retainer to the concavity of the flange.

As shown in FIG. 7, the concavity 9 in the flange 2 optionally has another slit 11 formed at the side thereof opposite to the slit 10. The base portion 5 of the retainer C is inserted from the slit 10 and penetrated through both the slits 10 and 11. Thus, the base portion 5 can be more securely fixed to the flange 2.

Figure 8:
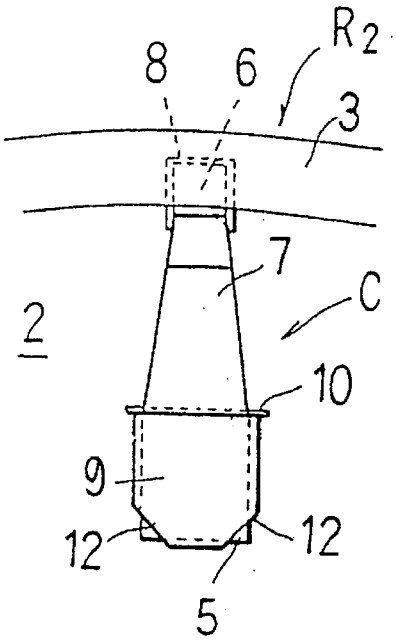
FIG. 8 is a plan view showing another variant of the fixation of the retainer to the concavity of the flange.

As shown in FIG. 8, the concavity 9 in the flange 2 optionally has cuts 12 formed at either corner of the side thereof opposite to the slit 10. The base portion 5 of the retainer C is inserted from the slit 10 through the cuts 12.

Figure 9:
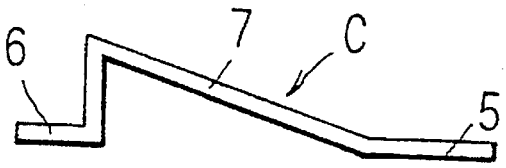
FIG. 9 is a side elevation of a variant of the retainer used in the present invention.
Figure 10:
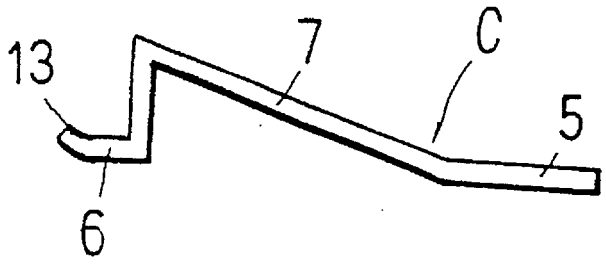
FIG. 10 is a side elevation of another variant of the retainer used in the present invention.
Figure 11:
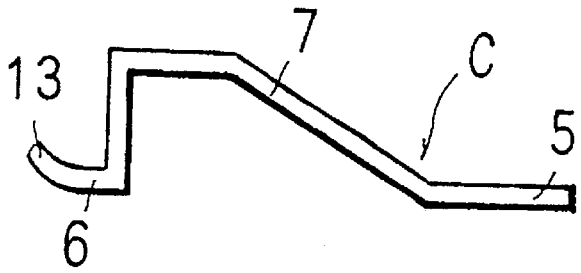
FIG. 11 is a side elevation of a still another variant of the retainer used in the present invention.

FIGS. 9 to 11 are side elevation views, respectively, of variants of the retainers C according to the present invention. To fix the retainer C to the flange 2 for the hook portion 6 to face the access hole 8 in the flange 2, the base portion 5 should preferably be shaped to be straight at a minimum of one of the sides thereof. For example, it should desirably be nearly square in shape. Also, to facilitate inserting the retainer C through the slit 10 and fitting it into the concavity 9, the corners of the base portion 5 are optimally rounded.

According to the present invention, the force for retaining a metallic filament is adjusted by selecting the resilience of the retainer C. For example, the thickness of a plate-like material for the retainer C, width and height of the intermediate portion 7 have only to be selected for this purpose. The metallic filament is retained as caught between the hook portion 6 and flange 2. For a more secure retention of the metallic filament, the end 13 of the hook portion 6 may be slightly bent or curved to wrap the metallic filament, as shown in FIGS. 10 and 11.

Figure 12:
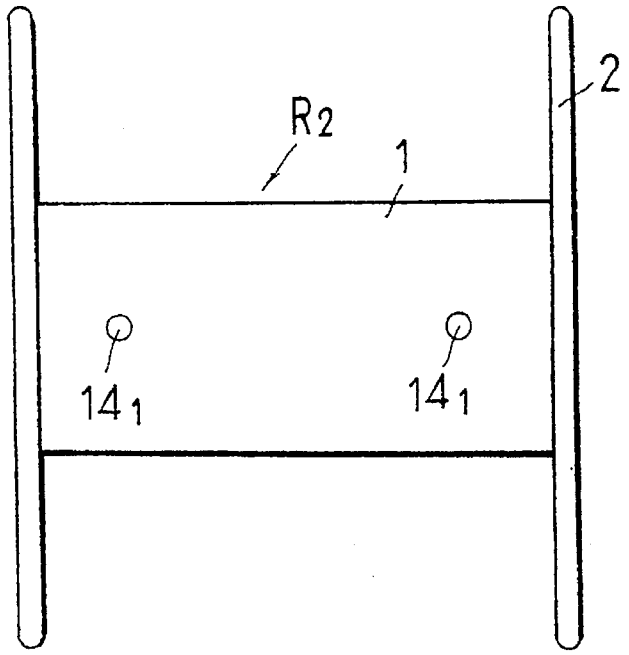
FIG. 12 is a front view of a winding drum of the reel, having holes formed therein.

FIG. 12 shows the winding drum 1 of the reel $R_2$, in which holes $14_1$ are formed. The holes $14_1$ receive and retain the leading end portion $W_b$ of a metallic filament to be wound on the winding drum 1. In this example, the winding drum 1 has formed axially therein a plurality of holes $14_1$ having a same diameter. In automatic winding of metallic filament onto the reel, it is possible to select one of the holes $14_1$ of which the position is suitable for retaining the leading end portion $W_b$ of the metallic filament and to detect such hole $14_1$ for insertion of the end portion of metallic filament.

Figure 13:
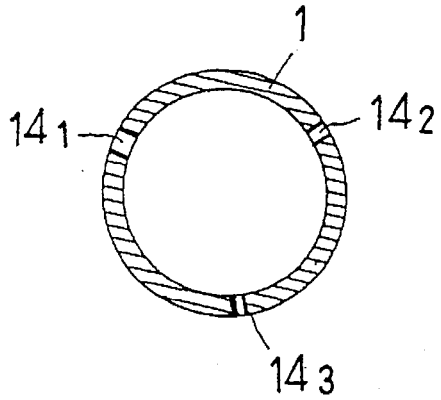
FIG. 13 is a cross sectional view taken radially of the winding drum of the reel.

FIG. 13 shows the winding drum I having formed circumferentially therein a plurality of holes $14_1$, $14_2$, $14_3$, . . . having different diameters, any one of which can be selected correspond to the diameter of the end portion $W_b$ of a metallic filament to be taken up on the reel. One reel can be used for taking up metallic filaments having different diameters.

According to the present invention, a metallic filament is not retained only with the base portion of the retainer secured to the flange but also with a portion of the flange other than the indented portion, so that the base portion remains rigidly secured to the flange. The retainer can be correctly placed and secured with little labor and time for positioning it with respect to the access hole. Therefore, the present invention has a great industrial value.

What is claimed is:

1. A metallic-filament take-up reel for carrying a filament, comprising:

a winding drum with first and second axial ends;

first and second flanges having inner sides respectively abutting said first and second axial ends to hold said filament therebetween;

at least one flange of said first and second flanges defining an access hole and a concavity on said inner side thereof, the concavity having a base surface and a peripheral wall descending from said inner side to said base surface;

said at least one flange further defining an aperture in a portion of said peripheral wall;

a metallic-filament retainer having a base portion fixed to said base surface of said concavity, a hook portion, and an intermediate portion connecting said hook portion to said base portion;

said intermediate portion extending from said base portion through said aperture and terminating at said hook portion to dispose said hook portion above the access hole for passage therethrough to catch said filament between said inner side and said hook portion; and said retainer being formed of a material having a modulus of elasticity sufficient for permitting deflection of said hook portion through said access hole and for retaining said filament between said inner side and said hook portion.

2. A metallic-filament take-up reel as set forth in claim 1, wherein said at least one flange has a rounded circumferential edge and the access hole is proximate said rounded circumferential edge.

3. A metallic-filament take-up reel as set forth in claim 1, wherein the base portion of the retainer has a thickness less than a depth of the concavity so as not to protrude beyond a plane of the inner side.

4. A metallic-filament take-up reel as set forth in any one of claims 1 and 3, wherein the winding drum defines holes extending in a radial direction and having differing diameters for anchoring filaments of substantially corresponding diameters.

5. A metallic-filament take-up reel as set forth in claim 3, wherein said at least one flange has a rounded circumferential edge and the access hole is proximate said rounded circumferential edge.

* * * * *